United States Patent [19]

Giorno

[11] Patent Number: 4,543,916

[45] Date of Patent: Oct. 1, 1985

[54] INDUCED CONTROLLED DETONATION INTERNAL COMBUSTION ENGINE

[76] Inventor: Vincent L. Giorno, 4328 N. Keeler Ave., Chicago, Ill. 60641

[21] Appl. No.: 555,157

[22] Filed: Nov. 25, 1983

[51] Int. Cl.[4] ..... F02B 75/04

[52] U.S. Cl. ..... 123/48 A; 123/74 A; 123/65 W; 123/192 R

[58] Field of Search ..... 123/74 R, 74 A, 74 AA, 123/46 R, 48 AA, 192 R, 323, 668, 669, 48 A, 65 W, 78 A

[56] References Cited

U.S. PATENT DOCUMENTS

| | | | |
|---|---|---|---|
| 1,022,390 | 4/1912 | Jennings | 123/78 AA |
| 1,389,017 | 8/1921 | Stewart | 123/192 R |
| 1,754,410 | 4/1930 | Allwill | 123/48 AA |
| 1,854,285 | 4/1932 | Williams | 123/65 W |
| 2,038,271 | 3/1933 | Curtis | 123/65 W |
| 2,420,117 | 5/1947 | Weatherup | 123/48 AA |
| 3,119,462 | 1/1964 | McMahan | 123/74 A |
| 3,194,007 | 7/1965 | Bouvier et al. | 123/46 R |
| 3,695,239 | 10/1972 | Papst | 123/65 W |
| 4,148,284 | 4/1979 | Prosen | 123/78 AA |

FOREIGN PATENT DOCUMENTS

| | | | |
|---|---|---|---|
| 2306039 | 8/1974 | Fed. Rep. of Germany | 123/668 |
| 918385 | 10/1946 | France | 123/323 |
| 498735 | 9/1954 | Italy | 123/48 AA |
| 31820 | 3/1979 | Japan | 123/48 AA |

OTHER PUBLICATIONS

"All About The Bourke Engine . . . How It Works", Sport Aviation, Jul. 1962, pp. 22–25.

"All About . . . The Bourke Engine", Sport Aviation, Aug. 1962, pp. 25–28.

"More On The Bourke Engine", Sport Aviation, Mar. 1963, p. 30.

*Primary Examiner*—Ira S. Lazarus
*Assistant Examiner*—R. S. Bailey
*Attorney, Agent, or Firm*—Hill, Van Santen, Steadman & Simpson

[57] ABSTRACT

A two-stroke cycle nonscavenged internal combustion engine operates under controlled detonating conditions without damage to the engine and with greatly enhanced fuel economy. The engine may have any desired number of cylinders operating initially on a two-stroke cycle with spark and then under auto ignition conditions. A variable compression device is provided in each cylinder to store excess energy liberated at peak pressures and to release it back to the piston during its power stroke. A Scotch yoke connection between the piston rod and crank shaft is laterally guided to eliminate side thrust. A bounce piston shock absorber is provided to assist piston reversal and dampen inertia forces. The fuel-air mixture is introduced under the piston, transferred through swirl passages, containing converging diverging nozzles, to the top of the piston, and exhaust gases exit under their own pressures trapping some so as to retain unburned hydro-carbon and oxygen radicals in the combustion zone for mixture with the fresh fuel-air mixture. These highly chemically active radicals initiate an auto ignited combustion which is controlled by the dilutent effects of the inert portions of the exhaust gases.

9 Claims, 9 Drawing Figures

INDUCED CONTROLLED DETONATION INTERNAL COMBUSTION ENGINE

BACKGROUND OF THE INVENTION

1. Field of the Invention

This invention relates to the art of improving the efficiency and wear life of internal combustion engines, especially two-stroke cycle engines and specifically deals with a fully integrated engine construction which produces or induces a novel form of controlled detonating combustion overcoming limitations of Otto and Diesel cycle engines. The power piston floats on an air cushion, and hydrocarbon emissions are decreased by retaining unburned fuel radicals. The engine absorbs destructive stresses.

2. Prior Art

While it is known that internal combustion engines will run under detonating conditions, the higher temperatures and stresses producing these conditions tend to damage and destroy the engine structure as well as causing them to operate less efficiently than under so-called normal combustion conditions. It would, therefore, be an improvement in the art to provide internal combustion engines which operate efficiently under controlled detonating, lean fuel conditions, without engine damage and having improved specific fuel consumption.

SUMMARY OF THE INVENTION

The present invention now provides a totally integrated engine construction, the components of which are carefully manufactured and arranged to provide the environment for a new type of combustion referred to herein as "induced controlled detonation". The engine structure provides unique components and arrangements which exploit the chemical kinetic basis for this new combustion and will withstand the stresses created thereby. The engine operates on a two-stroke cycle without a "blow down", thereby having twice the theoretical power of a four-stroke cycle engine. Since no portion of the power stroke is wasted to vent still burning gases, the charge is fully consumed and transferred during exhaust and does not cause a backfire of the fresh charge. This fresh charge is swirled to the top of the combustion chamber as exhaust gases are leaving thereby creating a higher pressure which aids the discharge of these spent gases but does not attempt to push them out as in the usually scavanged engine which allows short circuiting of the charges.

The engines of this invention withstand high temperatures and high compression ratios, to operate under controlled detonating conditions, do not waste fuel or energy to scavenge exhaust gases, burn retained reactive combustion products or active radicals from a preceding burned fuel charge, float the piston on a column of air, have a variable compression ratio device limiting peak pressures, storing energy and delivering the stored energy back to the power stroke of the engine, and introduce the fuel-air mixture under the piston for transfer through fuel atomizing swirl passages to the combustion chamber. A spark plug is used for ignition only until the engine reaches self-detonating temperatures and pressure conditions.

The preferred embodiment is a single or a multiple cylinder piston symmetrically ported engine with a reed valve in the intake port, discharging under the piston on the ascending stroke and closed on the descending stroke, to accommodate compression of the charge which is then released through swirl passages to the top of the combustion chamber and descends to mix with combustible radicals remaining from the previous combustion. The exhaust port is positioned above the bottom of the stroke and an exhaust valve is timed to open on the descendancy stroke just long enough to discharge a portion of the exhaust gases so as to retain in the combustion chamber at least some of the gases containing combustion radicals that will be mixed with the next fuel charge to aid in its auto ignited combustion. The exhaust gases exit under pressure conditions remaining after combustion and during transfer so that no power is lost pushing them out of the cylinder with a scavenging pump. Such pump usually has 1.2 to 1.4 times the air capacity of the engine.

Hydrocarbons in the exhaust gases are thus minimized and the fuel charge composed of the newly admitted fuel-air mix, diluted by the retained gases, will be lean enough relative to its mass, to prevent damaging vibratory detonation resulting in a "controlled detonation" which enhances engine performance.

In addition, the engine is protected against undue stresses by a spring loaded expansion piston opposing the power delivery piston to absorb shock from the rapid almost constant volume combustion, and then gradually restore the energy back to the power piston on its power stroke. This provides a flatter mean effective pressure curve and eliminates heretofore encountered "spikes" from the curve such as occur in detonating engines.

The power piston has a fixed rod connected through a laterally guided Scotch yoke to the crank shaft thereby eliminating heretofore required connecting rods, pins, shaft bearings and the like and avoiding the heretofore encountered side thrusts.

The preferred variable compression device can take the form of a spring biased piston in the head of the cylinder which retracts under peak pressures to compress the spring which then expands on the descending power stroke of the piston to deliver the stored up energy which is developed at peak pressures. The combustion chamber area has no water jackets and is insulated with high temperature ceramic materials to operate efficiently at temperatures up to 3000° F. The spring rate of the variable compression device may be adjustable to accommodate operation at different compression ratios, but pressures as high as 2500 pounds per square inch can be tolerated without damage to the engine. The diluting effect of the retained exhaust gases may reduce the peak pressures to around 2000 pounds per square inch and the engine may efficiently operate at effective compression ratios of from 12–20 to 1. Further, the retained exhaust gases may reduce the operating temperatures to around 2000° F.

The exhaust gases are self scavenged being forced out at pressure existing at the end of the power stroke, while the transfer of the new fuel charge from the bottom to the top of the piston may occur at about 50 pounds per square inch.

Since the piston is not subjected to side thrusts, there is no piston slap and the piston need only have a short skirt to control the port openings.

A bounce piston is mounted in a chamber on the piston rod and serves to dampen shock in those installations where no opposing power piston is provided.

Since the combustion chamber is lined with high temperature resisting ceramic, the power piston may float on a column of air and will center itself in the combustion chamber to reduce friction. The faces of the power piston and the expansion piston exposed to the combustion chamber are also preferably covered with the high temperature resisting ceramic material.

While the fuel-air mix is supplied from a conventional carburetor, fuel injection systems are also useful in the engines of this invention.

A feature of the invention, therefore, is the provision of a device in the combustion chamber of an internal combustion engine which will expand the chamber under peak pressure, store up energy, and then deliver the stored up energy back to the energy piston on the power stroke.

Another feature of the invention is the provision in a two-stroke cycle internal combustion engine of a fuel feed to the underside of the piston on its upstroke followed by a fuel transfer to the top side of the piston on its down stroke through passages which will create sonic shock waves pulverizing fuel droplets into vapor.

Another feature of the invention is the elimination of side thrusts in an internal combustion engine with a laterally guided Scotch yoke connecting the piston rod with the crank shaft.

A still further object of the invention is to eliminate heretofore required water jackets in internal combustion engines through the use of high temperature resisting ceramic liners in the combustion chamber.

A still further object of the invention is to provide an internal combustion engine operating under controlled detonating conditions without damage to the engine and with a controlled fuel-air mix diluted with exhaust gases containing hydrocarbon radicals adding to the energy potential of the incoming fuel mix.

Another object of the invention is to provide a low friction engine having unlubricated silicon carbide pistons and silicon carbide liners arranged to trap a gas film therebetween.

Another object of the invention is to provide labyrinth seals for the piston.

A still further object of the invention is to provide an internal combustion engine which operates under induced controlled detonating condition throughout its entire range of operation.

Another object of the invention is to provide an engine where the burned gases escape under their own pressure and wherein a fresh fuel charge is fed to the top of the combustion zone so as not to flow out of the exhaust port. The charge is thus stratified until the exhaust port is closed and the piston begins its upstroke. A larger mass of gas concentration can thus be trapped in the cylinder, boosting the efficiency of the two stroke cycle engine.

Other and further objects and features of this invention will become apparent to those skilled in the art from the following detailed description of the annexed sheets of drawings which, by way of example only, illustrate a preferred embodiment of the invention.

ON THE DRAWINGS

AS SHOWN ON THE DRAWINGS

Figures 1, 3:
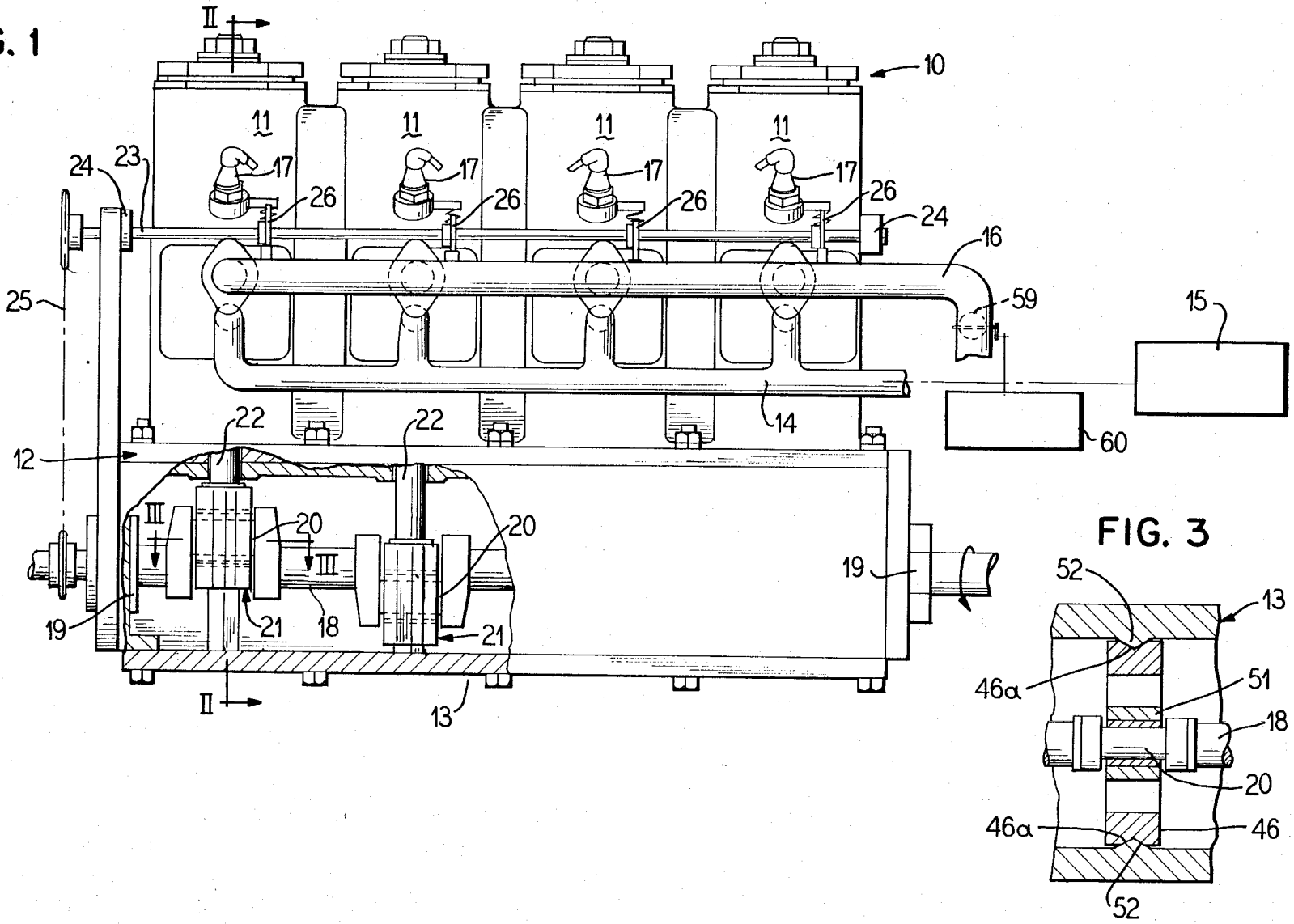
FIG. 1 is a side elevational view, with parts broken away and shown in section, of a multi-cylinder two-stroke cycle engine of this invention.
FIG. 3 is a horizontal cross-sectional view along the line III—III of FIG. 1.

The reference numeral 10 of FIG. 1 illustrates a four-cylinder two-stroke cycle internal combustion engine of this invention having four cylinders 11 each mounted on an engine block 12 from which is suspended a crank case 13.

The cylinders 11 are fed through a manifold 14 with a fuel/air mix from a carburetor diagrammatically illustrated at 15. Exhaust gases from each cylinder are removed through an exhaust manifold 16. Each cylinder has a spark plug 17 mounted thereon.

The crank case 13 houses a crank shaft 18 supported in main bearings 19 and having an eccentric crank pin 20 connected through a Scotch yoke 21 with each piston rod 22 descending into the crank case from the respective cylinders 11.

A cam shaft 23 rotatably mounted alongside the cylinders 11 in bearings 24 is driven through a chain and sprocket drive 25 from the crank shaft 18. A cam 26 for each cylinder 11 is mounted on the cam shaft 23.

Figures 2, 2A, 4:
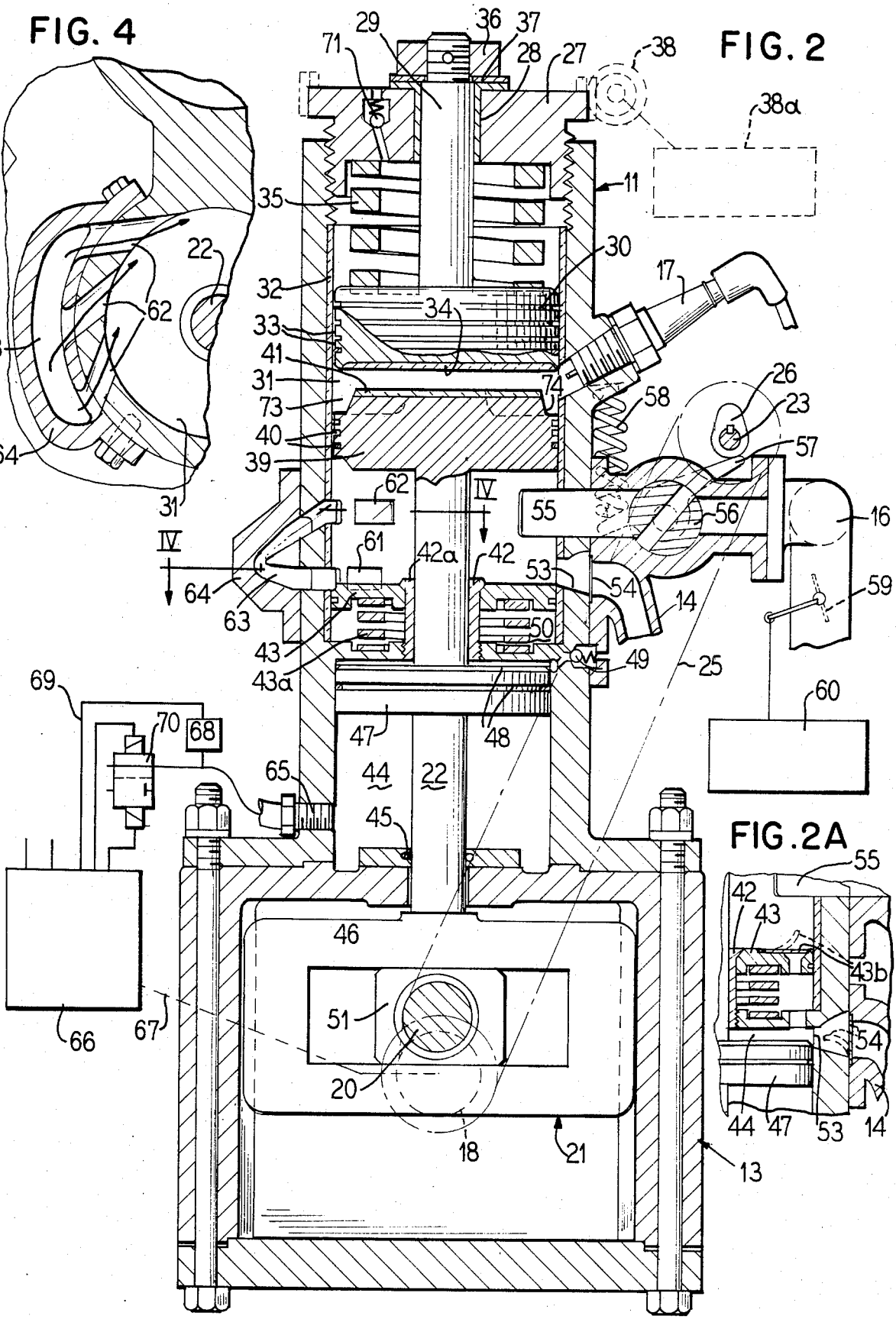
FIG. 2 is an enlarged vertical cross-sectional view along the line II—II of FIG. 1.
FIG. 2A is a fragmental cross-sectional view of a modified fuel intake port arrangement for the engine of FIG. 2.
FIG. 4 is a fragmentary cross-sectional view along the line IV—IV of FIG. 2.

As shown in FIG. 2, each cylinder 11 has a head 27 threaded in the upper end thereof carrying a bearing bushing 28 for the spindle 29 of a piston 30 depending into the combustion chamber 31 of the cylinder. This combustion chamber 31 is lined with a high temperature resisting ceramic insulator liner 32 and the piston head 30 has labyrinth seals or seal rings 33 to prevent free blow-by. The piston face is also covered with the refractive insulating material 34.

A compression spring 35 compressed between the cylinder head 27 and the piston head 30 surrounds the stem 29 and a nut 36 threaded on the top of the stem 29 is bottomed on the bushing 28 with an interposed washer 37 to suspend the piston head 30 in the upper portion of the liner 32 and to place an initial compression load on the spring 35.

The head 27 can be adjustably threaded into the top of the cylinder 11 to adjust and the level of the piston head 33 in the combustion chamber. A gear drive 38 controlled by a computer **38*a* can be provided to regulate the level and the compression load on the spring can be controlled to best engine operating conditions such as, for example, increasing the spring load where peak combustion pressures increase. The illustrated helical spring 35** could be replaced with a torsion rod spring.

Since it is intended that the engine operate at high temperature detonating conditions, no water jacket is needed for the cylinders 11.

A power delivery piston 39 is slidably mounted in the liner 32 below the piston 30 and has piston rings 40 or labyrinth seals confronting the liner 32. The piston 39 has a solid head or a short skirt with a free fit in the liner 32. The top face of the piston 39 is covered by a refractory insulator 41. The piston "floats" on the liner on a gas film.

The piston rod 22 is fixedly secured to the piston head 39 and depends from the bottom thereof through a bushing 42 carried by the engine block 12. An expansion plate 43 slides on the bushing 42 and liner 32 and is loaded by a spring 43*a* against a top shoulder 42*a* of the bushing 42 for a purpose to be hereinafter described. The piston rod 22 extends beyond the bushing 42 through a chamber 44 in the block 12 and then passes through a seal 45 into the crank case 13 where it is secured to the top of the cage 46 of the Scotch yoke 21.

A bounce piston 47 is secured to the piston rod 22 in the chamber 44 and rides on the wall of this chamber. Labyrinth seals or piston rings 48 can be provided on the bounce piston to prevent blow-by.

A spring loaded check valve 49 vents the portion of the chamber 44 above the bounce piston 48 and a chamber 50 under the spring loaded plate 43 with the atmosphere accommodating escape of compressed gases from these chambers but preventing air intake to the chambers.

The Scotch yoke cage 46 slidably supports a block 51 which rotatably mounts the crank pin 20 of the crank shaft. This block 50 is slidably mounted on tracks provided by the cage 46 and traverses the cage as it is reciprocated by the piston rod 22 thus performing its conventional "Scotch yoke" connection between the piston rod 22 and the crank shaft 18.

To minimize vibration and avoid side thrusts the cage 46 has grooves 46*a* in its side walls receiving tracks 52 on the inner faces of the side walls of the crank case 13 as shown in FIG. 3. Bearing bushings can be interposed between the tracks and grooves.

Each cylinder has a fuel-mix intake port 53 fed from the intake manifold 14 and communicating through a one-way reed valve 54 with the bottom of the chamber 31 to communicate with this chamber between the bottom of the power piston 39 and the spring loaded plate 43.

As shown in FIG. 2A, in place of the check valve 49 of FIG. 2, the intake port 53 of the FIG. 2 embodiment is located to discharge into the chamber 44 above the bounce piston 48 and passageways are provided through the engine block wall carrying the bushing 42 and through the expansion plate 43 so that the fuel-air mix, on the upstroke of the bounce piston 47, will be forced into the zone under the power piston 39 where the port 53 of the FIG. 2 arrangement discharged. A plate spring valve 43*b* is provided on the plate 43 controlling the fuel passage through the expansion plate 43. This valve arrangement flexes upward on the upstroke up the bounce piston 47 and closes on the downstroke.

Each cylinder 11 also has an exhaust port 55 communicating with the chamber 31 at a level above the port 53 and discharging into the exhaust manifold 16 under the control of a rotary valve 56 which is opened and closed by the cam 26 on the cam shaft depressing a finger 57 loaded by a spring 58 against the cam 26.

A butterfly valve 59 in the exhaust manifold 16 is controlled by a computer 60 to maintain a desired back pressure in the exhaust port 55 for a purpose to be hereinafter described.

Fuel transfer ports 61 and 62 are provided in the side wall of the chamber 31 opposite the ports 53 and 55 with the lower port 61 being about level with the port 53 and the upper port 62 being about midway between the top and the bottom of the port 55. These ports 61 and 62 are connected by a passageway 63 providing converging-diverging nozzles in a cap 64 secured to the outer face of the cylinder 11. This passageway, however, could be cast into the cylinder head 11.

The ports are arranged to swirl the fuel air mix and discharge it toward the top of the combustion chamber 31. As shown in FIG. 4, a plurality of ports 62 are provided and are tilted in a direction to swirl the incoming mixture circumferentially and upwardly of the combustion chamber 31. The passageway 63 between the lower ports 61 and upper ports 62 provides barrier walls impacted by and changing the direction of flow therethrough to atomize liquid droplets in the fuel air mix flowing therethrough.

The chamber 44 between the seal 45 and the bounce piston 47 receives bounce fluid such as air or liquid silicone through a port 65 communicating with the bottom of the chamber. The flow of the fluid is controlled from a computer 66 with a speed input 67 from the crank shaft. A pressure sensor 68 with an input 69 to the computer controls a valve 70 effective to feed fluid into the chamber and to drain fluid from the chamber. The arrangement is such that the bounce piston 47 will ride on a column of fluid under computer controlled conditions to damp shock effects of the piston at the end of its power stroke and to assist the piston in rising on its intake stroke. The right amount of dampening effect to absorb the kinetic energy caused by inertia while serving to reverse the movement of the piston at the bottom dead center and assisting at the beginning of its upstroke is thus provided.

Figure 5:
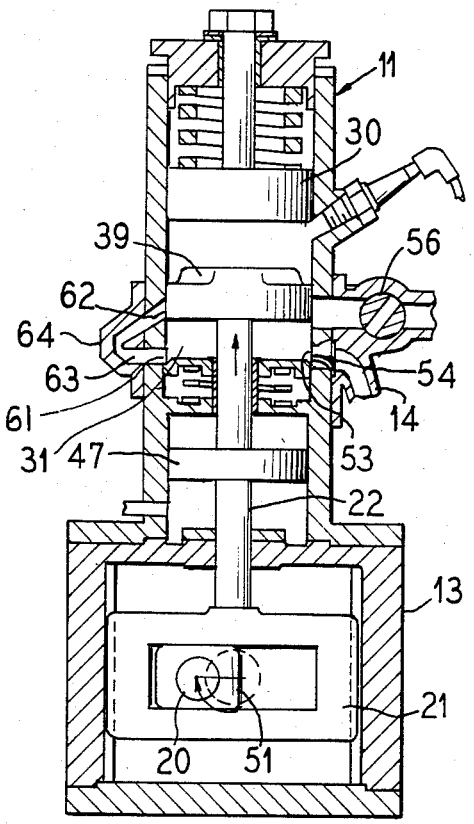
FIGS. 5–8 are views similar to FIG. 2 illustrating the various positions and functions of the elements during an operating cycle.
Figure 6:
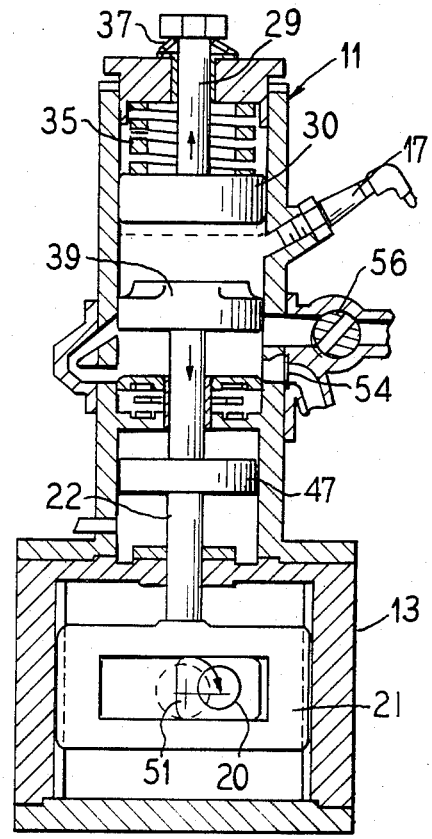

FIGS. 2, and 5 through 8 illustrate the positions of the components at various phases of the two-stroke cycle. Thus, FIG. 5 shows the position at the start of the upstroke where the fuel mix is introduced into the chamber 31. FIG. 2 then illustrates the position of the components at the point of ignition or top dead center of the piston stroke. FIG. 6 then shows the piston near the end of the power stroke and illustrates the retraction of the spring biased piston in solid line followed by a return to its initial position illustrated in dotted lines after delivering the stored up energy. It will be noted in FIG. 6 that the washer 37 is of the bellvue type illustrated in an expanded condition for cushioning the down stroke of the piston 30 from its retracted solid line position to its dotted line positions. It will be noted that the exhaust valve 56 is closed in all of the positions of FIGS. 2, 5, 6 and 8 while the intake reed valve 54 is only opened on the ascending stroke of the power piston 39 as shown in FIG. 5.

Figure 7:
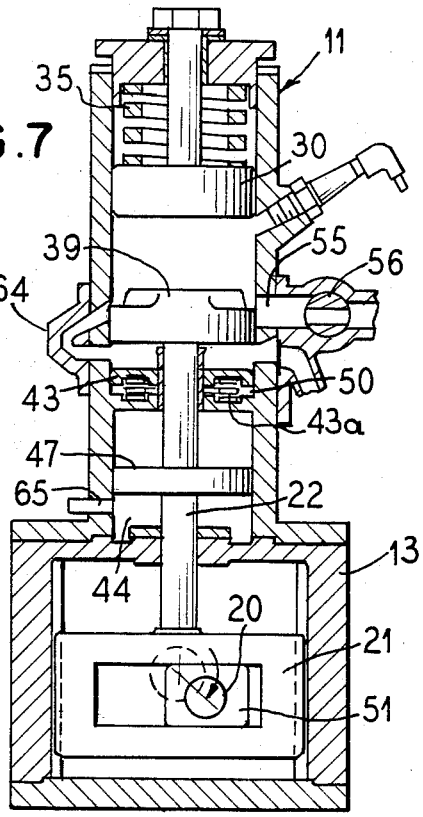
Figure 8:
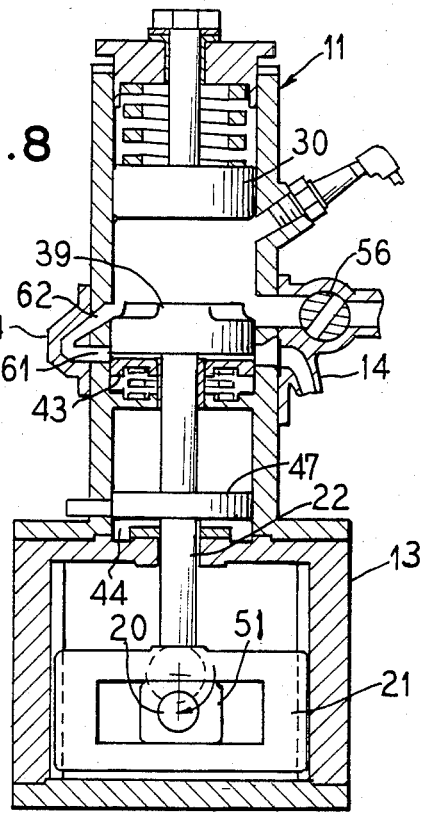

FIG. 7 illustrates the positions of the components near the end of the power stroke where the exhaust gases are discharging and then FIG. 8 shows that the discharge valve is closed during the last portion of the descending power stroke.

The spring loaded plate 43 is provided to relieve pressures on the trapped fuel charge between the bottom of the piston 39 and the plate after the reed valve is closed. High pressure in this zone could impede the power stroke.

It will also be noted in FIG. 2, that a spring loaded relief valve 71 is provided in the head 27 to vent the chamber between the head and the piston 30.

It will especially be understood that the piston 39 may have a rather free fit in the ceramic cylinder 32 and will actually ride on a cushion of air trapped between the piston and the cylinder thereby avoiding heretofore encountered piston ring friction in internal combustion engines.

It will also be noted that the piston head 39 has arcuate depressions or pockets 73 and 74 at diametrically opposite sides thereof with the pocket 73 facing the ports 61 and 62 to assist them in directing the fuel charge upwardly to the top of the combustion chamber 31 and with the pocket 74 communicating with the exhaust port 55 to scavenge exhaust gases through this port from the opposite side of the combustion chamber receiving the fuel mix. The arrangement is such that the incoming fuel mix will be directed to the top of one side of the combustion chamber while exhaust gases are discharged downwardly from the opposite side of the combustion chamber, thereby eliminating discharge of the fresh incoming fuel mix with the spent exhaust gases.

From the above descriptions, it should be readily understood that fuel is introduced through the reed valve 54 on the ascending stroke of the piston in a lower portion of the combustion chamber between the bottom of the piston 39 and the spring loaded plate 43. Upon approaching the top dead center of the piston stroke, combustion is effected either by a spark from the spark plug 17 or by sparkless auto or detonating ignition created by the high pressures and temperatures. A temperature sensor disconnects the spark plugs 17 when they are no longer needed for ignition.

On the descending power stroke, the fuel charge is trapped and loaded under the piston 39. When the pocket 74 of the piston communicates with the exhaust port 55 and when the exhaust valve 56 is opened, the exhaust gases escape from the combustion chamber until the exhaust pressures reach the minimum controlled by the butterfly valve 59. It will be especially noted that there is no positive scavenging of the exhaust gases from the chamber 31 and some of these gases will remain in the chamber when the valve 56 is closed. During the period when the valve 56 is opened, the ports 62 are still partially closed by the piston 39 and tnen after the exhaust cycle begins, the piston clears these ports 62 permitting full transfer of the compressed fuel mix from the bottom to the top of the piston for the next compression stroke.

It will, of course, be understood that the detailed description of the herein illustrated engine is submitted only as a preferred mode of structure and operation at the present time, and that many variations may be made without departing from the principles of the invention as defined by the hereinafter appended claims.

I claim as my invention:

1. An unscavenged two-stroke cycle internal combustion engine capable of efficient operation under controlled detonating high temperature and pressure conditions with a lean fuel-air mixture which comprises a cylinder, a power piston reciprocating in the cylinder, means providing a closed chamber coaxially aligned with and separated from said cylinder, a bounce piston slidable in said closed chamber, a piston rod fixedly connecting said power piston and said bounce piston, a fuel intake port discharging the fuel-air mixture into said chamber on the downstroke of the bounce piston, valved ports feeding the fuel-air mixture to the cylinder below the power piston on the upstroke of the bounce piston, an exhaust port in the cylinder opened by the power piston near the bottom of its stroke, fuel transfer ports in the cylinder conveying the fuel-air mixture from under to above the power piston at the bottom of the power piston stroke, a valve in the intake port opening only on the ascending stroke of the power piston, a valve in the exhaust port opening only during a portion of the stroke of the power piston clearing the port to retain residual gases in the cylinder, and said fuel transfer ports being constructed and arranged to atomize fuel flowing therethrough.

2. The engine of claim 1 wherein the closed chamber is a fluid-tight chamber under the piston head, and means control fluid flow into and out of the fluid-tight chamber in proportion to the speed of the engine.

3. The engine of claim 2 wherein the means controlling fluid flow into and out of the fluid-tight chamber is a computer sensing the engine speed and controlling the amount of fluid in the fluid-tight chamber.

4. The engine of claim 1 including a spring loaded plate under the power piston controlling pressure of the fuel mixture when the transfer ports are closed.

5. In a two-stroke cycle internal combustion engine operating under controlled detonating conditions including a cylinder, a power piston slidable in the cylinder, a fixed piston rod depending from the power piston, a crank shaft and a scotch yoke connecting the crank shaft and piston rod, the improvement which comprises a shock absorber piston secured to the piston rod between the power piston and the shock absorber piston and slidable in a fluid-tight chamber, means sensitive to the speed of the engine controlling fluid in the chamber under the shock absorber piston to counteract stresses caused by inertia of the power piston and to assist reversal of the power piston after it reaches the bottom of its stroke.

6. The engine of claim 5 wherein the fluid in the chamber is air.

7. An internal combustion engine comprising a cylinder having an upper combustion chamber with inlet and outlet ports and a lower closed chamber, a power piston slidably mounted in the combustion chamber, a bounce piston slidably mounted in the closed chamber, a crank case, a crank shaft mounted in said crank case, a scotch yoke in said crank case having a cross head and a cage, tracks in said crank case slidably supporting the cage of the scotch yoke, a fixed piston rod connecting the power piston, the bounce piston and the cross head of the scotch yoke, said cylinder having inlet and outlet ports for the combustion chamber, valves in said ports feeding a combustible mixture to the underside of the power piston on its ascending stroke and exhausting gases from the cylinder at the end of the power stroke, and transfer ports in the cylinder conveying the combustible mixture from the underside to the top side of the piston at the completion of the downstroke of the piston.

8. An unscavenged two-stroke cycle internal combustion engine capable of efficient operation under controlled detonating high temperature and pressure conditions with a lean fuel-air mixture which comprises a portion cylinder, a power piston slidable in said cylinder, ports in said cylinder controlled by said power piston to introduce fuel and discharging exhaust gases, a spring-biased head in the cylinder retracting under peak pressures and returning driving energy to the power piston on its power stroke, a first means controlling the spring bias on said head, and a second means independent of said first means sensitive to peak compression pressures in the cylinder regulating the level of the head in the cylinder whereby detonating high temperature and pressure conditions are tolerated without damaging the engine.

9. In an internal combustion engine, a ported cylinder, a piston slidably mounted in said cylinder controlling said ports, a loaded variable compression device in the cylinder opposing the piston, means adjusting the load on the device, means adjusting the level of the device in the cylinder, valves in said cylinder ports feeding a combustible mixture to the underside of the piston on its ascending stroke and exhausting gases at the end of its power stroke, fuel transfer ports in the cylinder having inlet ends receiving the combustible mixture from the underside of the piston on its descending stroke and outlet ends discharging fuel into the cylinder above the piston, said ports being connected by a nozzle passageway converging from the inlet ends on the underside of the piston and diverging to the outlet end discharging above the piston, a piston rod fixed to the piston, a crank shaft, a scotch yoke connecting the piston rod to the crank shaft for rotating the shaft, lateral guides for the scotch yoke, and stress absorbing means connecting to the piston rod between the piston and scotch yoke.

* * * * *